US010988936B2

(12) United States Patent
Soetanto

(10) Patent No.: US 10,988,936 B2
(45) Date of Patent: Apr. 27, 2021

(54) PERGOLA LOUVER TILT SYSTEM

(71) Applicant: Johanes Soetanto, Jakarta (ID)

(72) Inventor: Johanes Soetanto, Jakarta (ID)

( * ) Notice: Subject to any disclaimer, the term of this patent is extended or adjusted under 35 U.S.C. 154(b) by 221 days.

(21) Appl. No.: 16/404,064

(22) Filed: May 6, 2019

(65) Prior Publication Data

US 2020/0354961 A1 Nov. 12, 2020

(51) Int. Cl.
*E04F 10/10* (2006.01)
*E06B 7/082* (2006.01)

(52) U.S. Cl.
CPC ..... *E04F 10/10* (2013.01); *E06B 7/082* (2013.01)

(58) Field of Classification Search
CPC ..... E04F 10/10; E06B 7/082
See application file for complete search history.

(56) References Cited

U.S. PATENT DOCUMENTS 2,867,008 A * 1/1959 Soule ..... E06B 3/5009 49/79.1
4,527,355 A * 7/1985 Numakami ..... E04F 10/10 49/275
5,306,210 A 4/1994 Smit
5,732,507 A 3/1998 Edwards
7,335,096 B2 * 2/2008 Perez ..... E04B 7/163 454/358
7,770,623 B2 * 8/2010 Wong ..... E06B 7/082 160/133
8,756,873 B1 * 6/2014 Hire ..... E04F 10/10 52/72
9,422,715 B1 * 8/2016 Selzer ..... E04D 11/00
9,644,374 B2 5/2017 Ivic
9,650,786 B2 * 5/2017 Weaver ..... E04B 7/163
10,094,122 B1 * 10/2018 Akbulut ..... E04F 10/10
10,815,689 B2 * 10/2020 Ji ..... H02S 20/30
10,858,840 B2 * 12/2020 Ji ..... E06B 7/086

FOREIGN PATENT DOCUMENTS

WO WO-2011121370 A2 * 10/2011 ..... E04F 10/08

* cited by examiner

*Primary Examiner* — Beth A Stephan
(74) *Attorney, Agent, or Firm* — Clement Cheng

(57) ABSTRACT

A pergola louver tilt system has a crossbeam with a track with a track groove. The system also has a post mounted on the crossbeam. A louver clip is pivotally mounted to post at a post joint. A louver is mounted to the louver clip. A pivot link is pivotally mounted to the louver clip. A stem is mounted to slide on the track groove. The pivot link is pivotally mounted to the stem at a stem connection pivot formed on the stem. A link connecting the stem to an adjacent stem, wherein the link includes a first link connection and a second link connection, wherein the first link connection connects to an adjacent stem, and wherein the second link connection connects to a subsequent stem.

17 Claims, 8 Drawing Sheets

PERGOLA LOUVER TILT SYSTEM

FIELD OF THE INVENTION

The present invention is in the field of pergola tilt louver systems.

DISCUSSION OF RELATED ART

A variety of different pergolas have been invented in the past, such as Self Ventilated Pergola described in WO 2011/121370A2 by inventor Konstantinos Spiliopoulos, published Oct. 6, 2011, the disclosure of which is incorporated herein by reference, which shows a pergola with blade panels having hook ends. In U.S. Pat. No. 5,306,210 to Smit, issued Apr. 26, 1994, entitled Louver Type Roof Structure has a plurality of parallel transversely mounted on carrier beams extending transversely to the slats, the disclosure of which is incorporated herein by reference. A variety of different pergola louver cover folding mechanisms have been created, such as seen in U.S. Pat. No. 9,644,374 issued May 9, 2017 entitled Pergola Cover, the disclosure of which is incorporated herein by reference. Edwards in U.S. Pat. No. 5,732,507 entitled Louvre Assembly issued Mar. 31, 1998 provides a pivoting profile having interengagement means, the disclosure which is incorporated herein by reference.

SUMMARY OF THE INVENTION

The present invention is an improvement over the prior art in that it provides a modular system of interconnecting links for decreasing binding commonly associated with interlocking louver systems. A pergola louver tilt system has a crossbeam with a track with a track groove. The system also has a post mounted on the crossbeam. A louver clip is pivotally mounted to a post at a post joint. A louver is mounted to the louver clip. A pivot link is pivotally mounted to the louver clip. A stem is mounted to slide on the track groove. The pivot link is pivotally mounted to the stem at a stem connection pivot formed on the stem. A link connects the stem to an adjacent stem. The link includes a first link connection and a second link connection. The first link connection connects to an adjacent stem, and the second link connection connects to a subsequent stem in a sequential chain.

The track groove can be formed on an upper surface of the crossbeam. The post can be an inside post. An outside post is mounted on the crossbeam adjacent to the inside post. The louver has a louver flat portion with a louver upper bend extending from the louver flat portion and a louver lower bend also extending from the louver flat portion. The louver upper bend terminates at a louver upper hook. The louver lower bend terminates at a louver lower hook.

The stem connection pivot is formed as a stem connection opening. The stem further includes a stem slot, and the stem slot receives the pivot link. The pivot link has a flat shape configured to fit into the stem slot. The pivot link rotates relative to the stem connection opening inside the stem slot. The link is modular and removable. The louver clip further includes a clip flange mount is formed as a flat rib extending perpendicularly from the louver clip toward the post. The clip flange mount is pivotally mounted to the post joint.

The following call out list of elements can be a useful guide in referencing the element numbers of the drawings.

21 Inside Post
22 Outside Post
30 Louver Clip
131 First Row Of Louver Clips
132 Second Row Of Louver Clips
133 Third Row Of Louver Clips
31 Louver Clip Lower Arm
32 Louver Clip Upper Arm
33 Louver Clip Lower Arm Hook
34 Louver Clip Upper Arm Hook
35 Lower Arm Hook Edge
36 Upper Arm Hook Edge
37 Clip Flange Mount
38 Flange Pivot
39 Post Joint
41 Link
141 Adjacent Link
241 Subsequent Link
42 First Link Connection
43 Second Link Connection
44 Actuator Bar
45 Actuator Link
46 Actuator Link Connection
47 Link Bend
48 Second Link Connection Opening
49 First Link Connection Opening
50 Stem
150 Adjacent Stem
250 Subsequent Stem
51 Stem Base
52 Stem Connection Opening
53 Pivot Link
54 Post Pivot
55 Track
56 Track Groove
57 Stem Slot
58 Column
59 Cross Beam
60 Louver Panel
61 Lower Flat Portion
62 Louver Upper Edge
63 Louver Lower Bend
64 Louver Lower Hook
65 Louver Upper Hook
66 Louver Lower Hook Edge
67 Louver Upper Hook Edge
68 Louver Right Edge
69 Louver Left Edge
71 Transmission Axle
72 Axle Bushing

DETAILED DESCRIPTION OF THE PREFERRED EMBODIMENT

Figure 1:
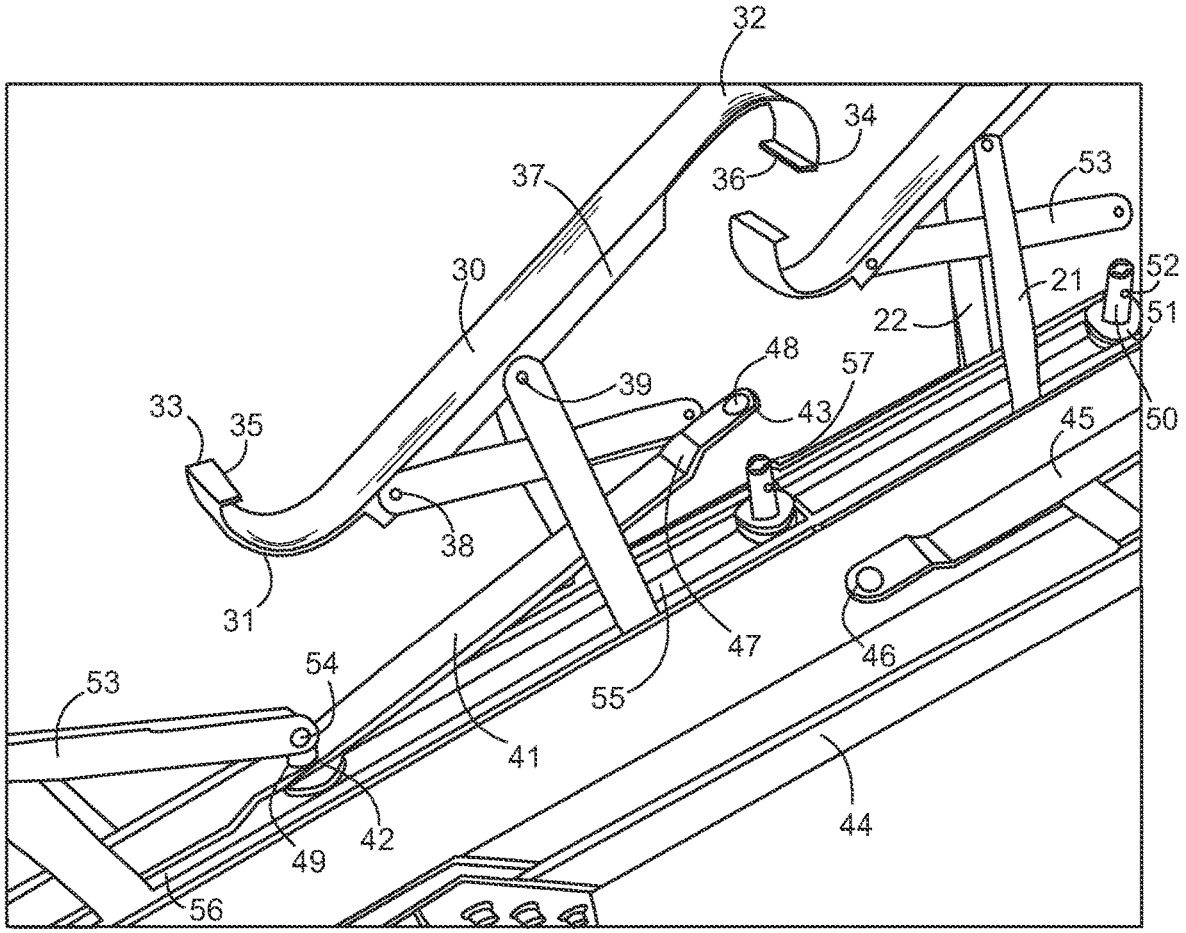
FIG. 1 is a top perspective view of the louver clip mechanism.

As seen in FIG. 1, a right row or a left row of louver clips 30 are configured to clip onto louvers. The louver clips 30 rotate from a closed position to an open position. The louver clips 30 are mounted to an inside post 21 and an outside post 22. The inside post 21 is for the interior of the pergola and the outside post 22 is toward the extremity of the pergola. The inside post 21 and the outside post 22 can be formed of metal strips or bars such as extruded aluminum or thick stainless steel. A first post can be the inside post and a second post can be the outside post. Alternatively, the first post can be the outside post and the second post can be the inside post. Alternatively, there can be just one post. A variety of different extruded, welded, punched, molded or cast metal or composite structures can be used to fabricate the post.

Each louver clip 30 has a louver clip lower arm 31 and a louver clip upper arm 32. The louver clip lower arm 31 and the louver clip upper arm 32 flex relative to the louver clip 30. The flexible arms extend around the edge of each louver and lock the louver to the louver clip 30. The louver clip is preferably made of an aluminum extrusion, or steel bended sheet. The louver clip lower arm hook 33 and the louver clip upper arm hook 34 further include a lower arm hook edge 35 and an upper arm hook edge 36. The louver clip 30 also preferably includes a clip flange mount 37 that can either extend from a longitudinal edge of the louver clip 30, or can extend from a middle lower portion of the louver clip 30. The clip flange mount 37 is connected to a flange pivot 38 that retains and actuates the louver clip 30. The louver clip 30 is structurally pivotally mounted to the post joint 39.

A link 41 transmits the actuation motion to the louver clip 30 and a series of links 41 transmits the actuation motion from one louver clip to another. The link 41 has a first link connection 42 and a second link connection 43. The first link connection 42 and the second link connection 43 can be formed as openings such as circular openings. The circular openings can fit over the stem 50. The link 41 is discrete and can be added modularly with additional louver clips 30 so as to extend the length of a pergola.

The louver clips 30 rotate when an actuator bar 44 moves. The actuator bar 44 is mounted to an actuator link 45. The actuator link 45 is similar to the link 41, except that it is connected to the actuator bar 44. The actuator bar 44 can be rigidly mounted to the actuator link 45. The actuator link 45 has an actuator link connection 46 which may also have a circular opening for fitting over the stem 50.

Certain links 41 may have a link bend 47 to allow overlapping of links 41. The first link connection 42 can be formed as a first link connection opening 49 and the second link connection 43 can be formed as a second link connection opening 48. Both of these openings are sized to fit over the stem 50 with a minimal amount of play. The stem base 51 can be circular disk shape and fit into a track groove 56 so that the stem base 51 slides along the track groove 56. The stem 50 can have a stem connection pivot formed as a stem connection opening 52 for receiving a post pivot 54 of the pivot link 53. The post pivot 54 can be a pin joint or riveted joint similar to the flange pivot 38. The track 55 is preferably an aluminum extrusion with a track groove 56 formed therein. The stem 50 may also have a stem slot. The stem slot 57 preferably receives the flat tip of the pivot link 53. So that the post pivot 54 engages with the stem connection opening 52.

Figure 2:
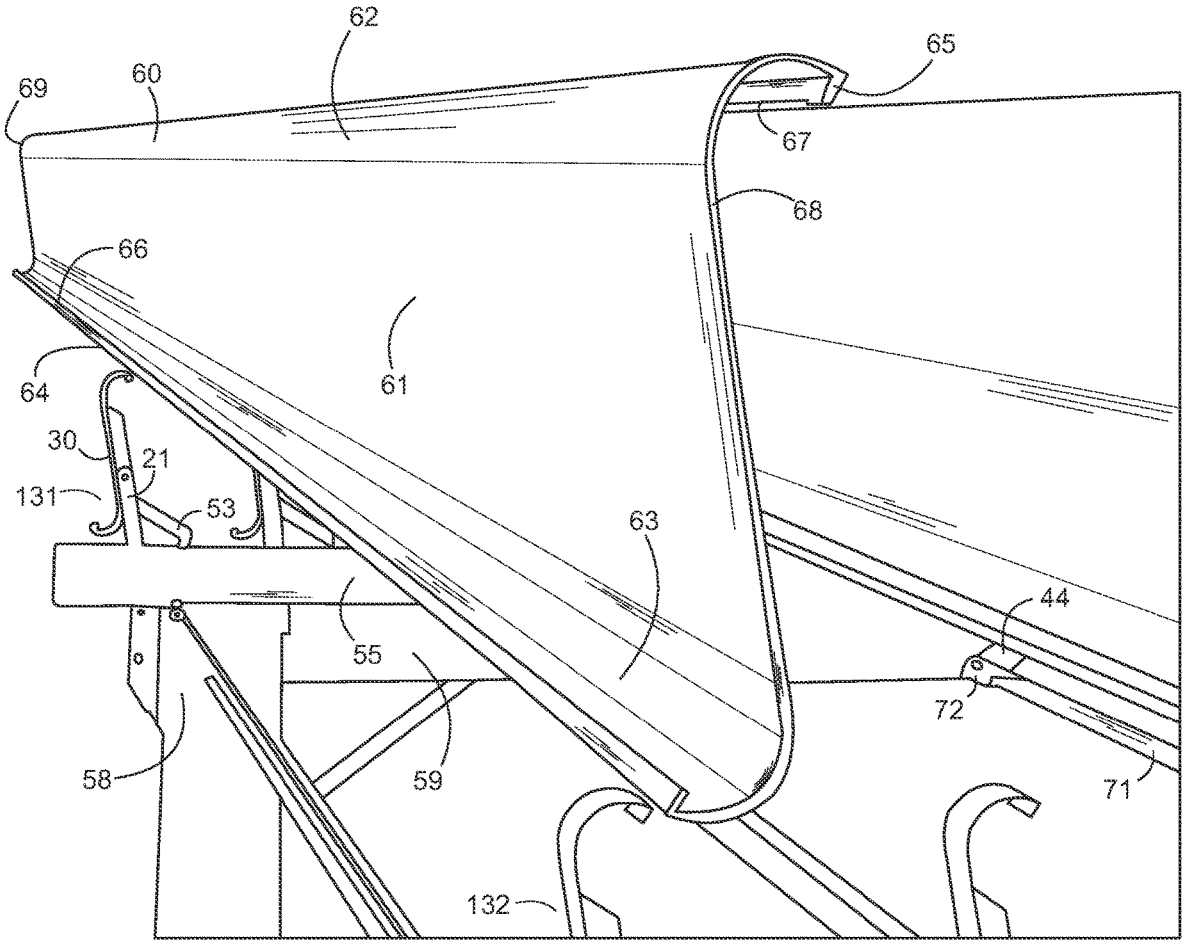
FIG. 2 is an exploded view of the louver clip mechanism and detail of the louver panel.

As seen in FIG. 2, the louver panel 60 has support by the inside post 21 and the louver clip 30. The actuator bar 44 rotates the transmission axle 71 relative to an axle bushing 72. The transmission axle 71 connects to a pair of actuator bars 44, a left actuator bar and a right actuator bar actuate a left row of louver clips and a right row of louver clips. Thus, the right row of louver clips and the left row of louver clips are mechanically connected through the transmission axle 71. The transmission axle 71 provides an even force output between the left and right sides. The transmission axle 71 works in any orientation so that the louver can be vertically mounted as a wall in addition to a roof.

The general configuration of the pergola is rectangular but can also be made in a variety of different shapes such as square or octagonal. The pivot link 53 is also formed in a pair of rows, namely a left row of pivot links and a right row of pivot links provide a left and right symmetrical force transmission. Similarly, the track 55 is also formed with a right track and the left track supporting the right and left rows of pivot links and louver clips. Columns 58 provide a vertical support for the pergola crossbeams 59. The crossbeams 59 can be integrally formed with the track 55, or can be made as separate members. Preferably, the crossbeams 59 are integrally formed with the track 55 and the groove on the track.

The louver panel 60 has a louver flat portion 61 that extends upwardly to a louver upper bend 62. The louver flat portion 61 also extends downwardly to a louver lower bend 63. The louver lower bend 63 has a louver lower hook 64 that terminates at a louver lower hook edge 66. Similarly, the louver upper bend 62 extends to a louver upper hook 65 with a louver upper hook edge 67. The louver panel 60 also includes a louver right edge 68 and a louver left edge 69. The louver upper hook edge 67 engages to the upper arm hook edge 36, and the louver lower hook edge 66 engages to the lower arm hook edge 35. Thus, the louver panel 60 snaps to the right louver clip and the left louver clip. The louver clips 30 are formed as springs for bias retention of the louver panels 60.

Figure 3:
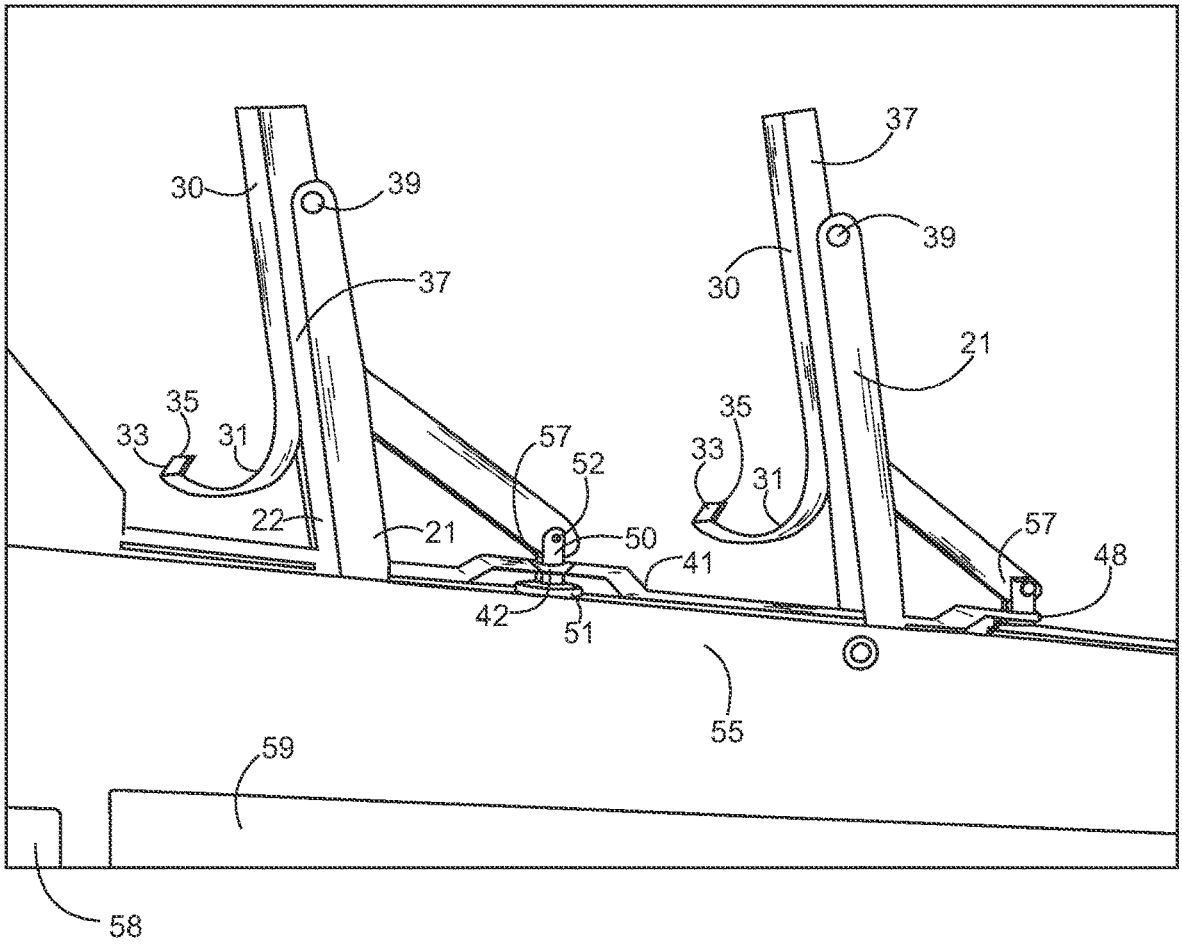
FIG. 3 is a side view of the louver clip mechanism.

As seen in FIG. 3, the pergola louvers can be rotated to an open position. In an open position, the louver clips 30 are mounted between and on the inside post 21 and the outside post 22. The louver clip lower arm 31, the louver clip lower arm hook 33, and the lower arm hook edge 35 can be extended downwardly when the pergola is in an open position. The clip flange mount 37 extends generally vertically after being pivoted on the post joint 39.

The link 41 connects to adjacent links and provides transmission of force equally to all of the stems 50 at the first link connection 42 and the second link connection opening 48. Each stem 50 extends upwardly from each stem base 51. Each stem connection opening 52 may communicate or cooperate with the stem slot 57 and provide a mounting to the pivot link 53. The track 55 extends horizontally to be supported by columns 58.

Figure 4:
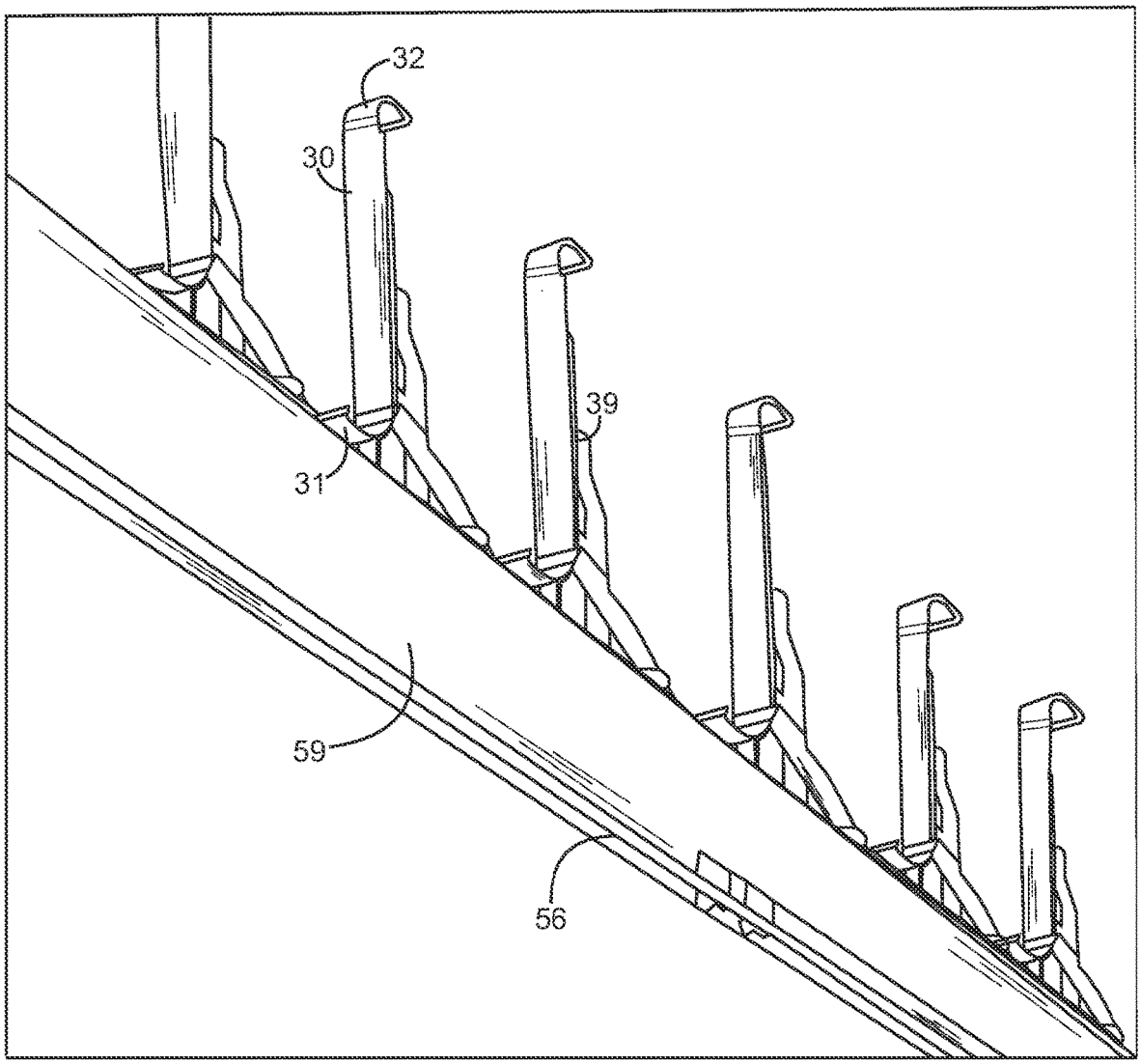
FIG. 4 is a lower perspective view of the louver clip mechanism.

As seen in FIG. 4, a right or left row of louver clips 30 are mounted on a track 55. A louver clip 30 has a louver clip lower arm 31 and a louver clip upper arm 32 where the louver clip lower arm 31 is below the louver clip upper arm 32 when the pergola is in an open position. The post joint 39 provides a pivoting mount for the louver clip 30. The actuator bar 44 can be optionally mounted underneath the track 55. A track groove 56 can extend through the track 55. The track 55 is preferably integrally formed with the crossbeam 59.

Figure 5:
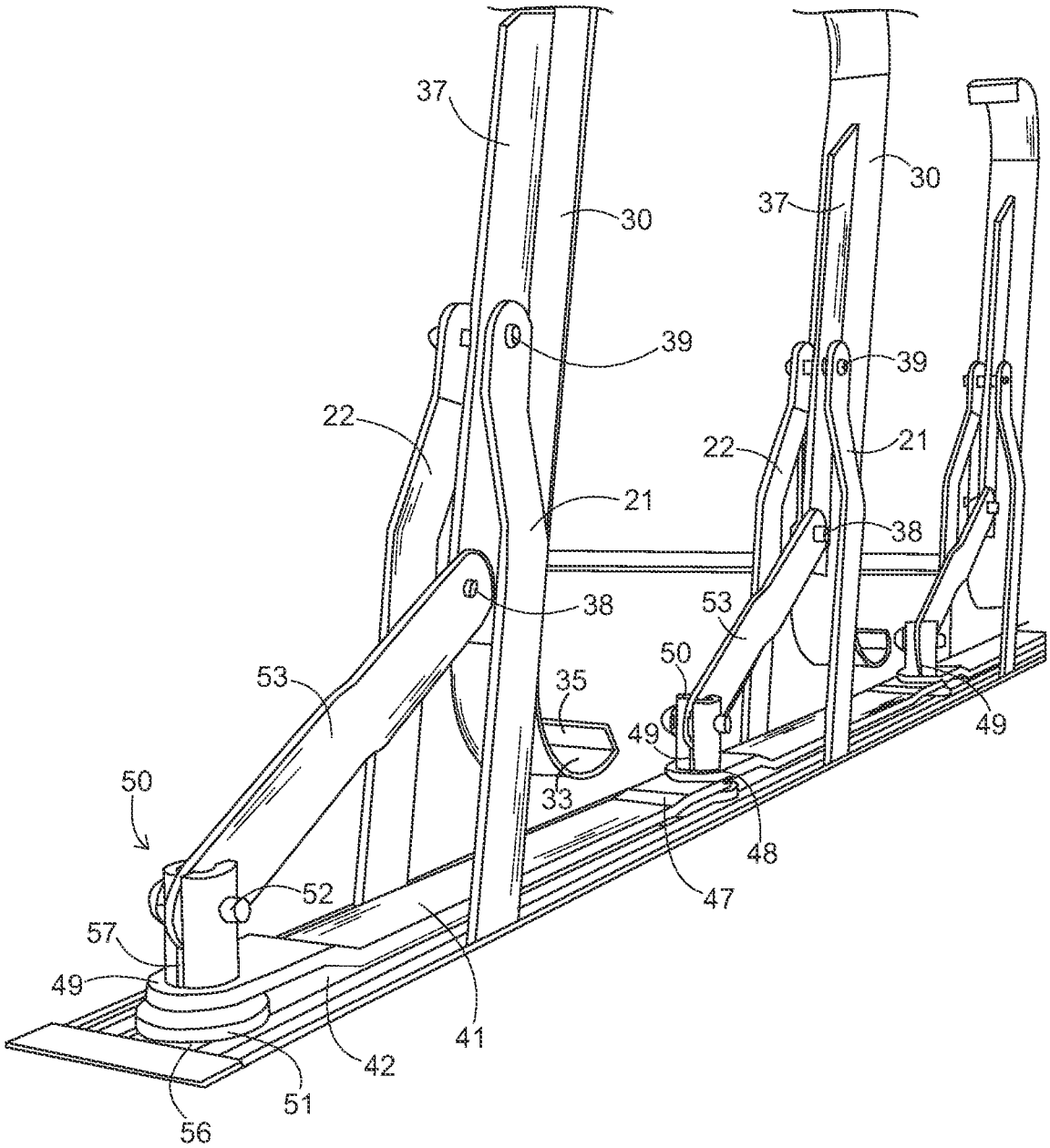
FIG. 5 is a close-up view of the louver clip mechanism.

As seen in FIG. 5, a close-up of a left or right row of louver clips 30 shows an inside post 21 parallel to an outside post 22, where both are made of flat steel or aluminum members. The parallel posts can be secured by bolts to the track 55 on a left and right side of the track 55. The louver clip 30 has a louver clip lower arm hook 33 with a lower arm hook edge 35. The clip flange mount 37 may bisect the left and right edges of the louver clip 30. The flange pivot 38 is below the post joint 39 when the link 41 retracts the pivot link 53 to an open position. The link 41 has a first link connection 42 at one end and a second link connection at a second end. The link 41 preferably has one or more link bends 47 2 allow overlapping with adjacent links such that a first link connection opening 49 of a link overlaps with a second link connection opening 48 of an adjacent link.

The first connection openings and the second connection openings fit over the stem 50. The stem 50 has a stem base 51 with a larger radius then a radius of the stem 50. The stem 50 may also have a stem connection opening 52. The stem base 51 is preferably disc-shaped and can have one or more disc-shaped members that fit into one or more track grooves 56 in an aluminum extrusion that is horizontally oriented. The stem slot 57 preferably passes through the stem 50 to allow free rotation of the pivot link 53 relative to the stem connection opening 52.

Figure 6:
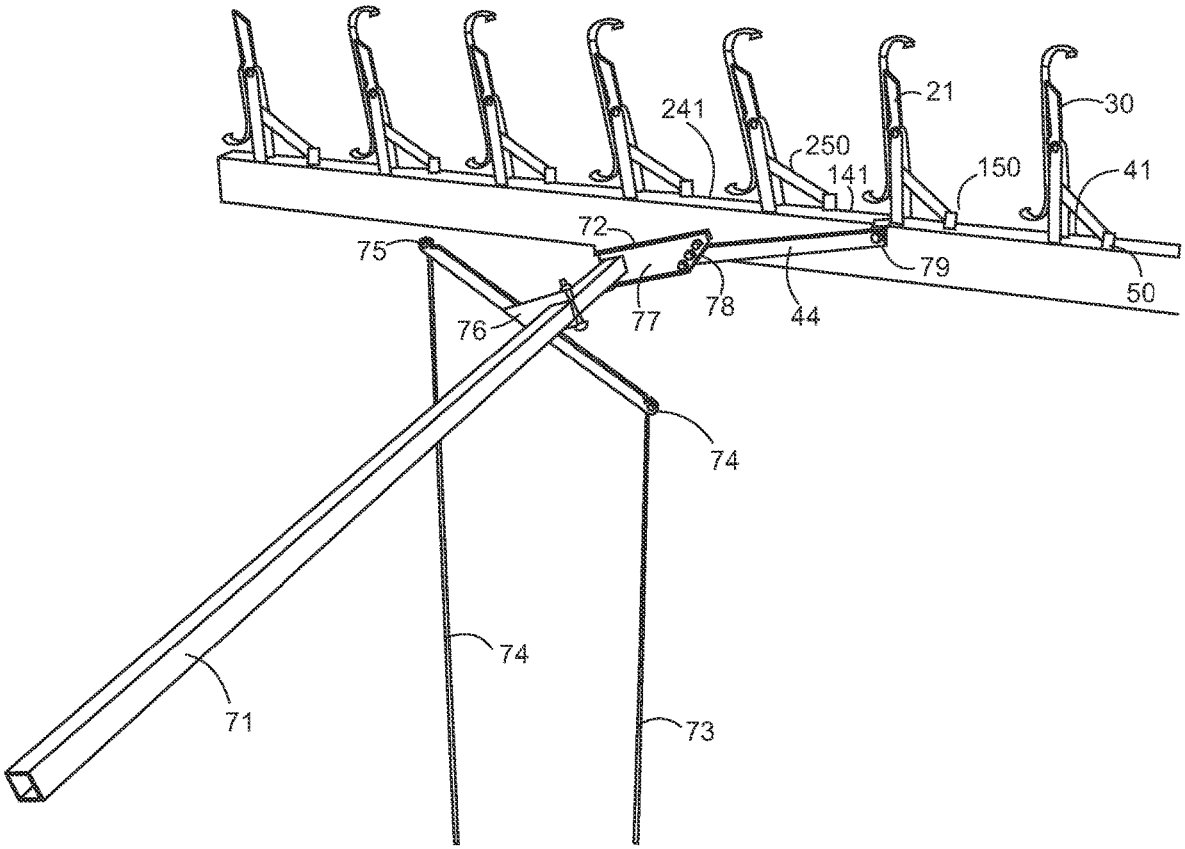
FIG. 6 is a diagram of the actuator pivot arm mechanism.

As seen in FIG. 6, the transmission axle 71 rotates in a clockwise and counterclockwise direction. When a user pulls the close pull cord 74 attached to the close pull junction 75, the transmission axle 71 rotates. The transmission axle 71 is connected to the actuator pivot arm 77. The actuator coupler 76 is hinged to the actuator bar 44. The actuator coupler 76 can be formed as a bar having an open pull junction 74 on one side, and having a close pull junction 75 on another side. The actuator coupler 76 is preferably rigidly mounted to the actuator pivot arm 77. The actuator pivot arm 77 is mounted to the actuator bar 44 at an actuator pivot arm joint 78. The actuator bar 44 is preferably mounted to the actuator link 45 at an actuator bar joint 79. A pair of actuator bars actually a left and right set of louver clips 30. FIG. 6, can be a left row or right row of louver clips. Thus, the stem 50 is connected to an adjacent stem 150 which is in turn chained to a subsequent stem 250 in a sequential chain configuration. Similarly, the link 41 is preferably connected to an adjacent link 141 which is in turn connected to a subsequent link 241. For example, twelve links can connect eleven stems on the right side, and then another twelve links can connect eleven stems on a left side.

Figure 7:
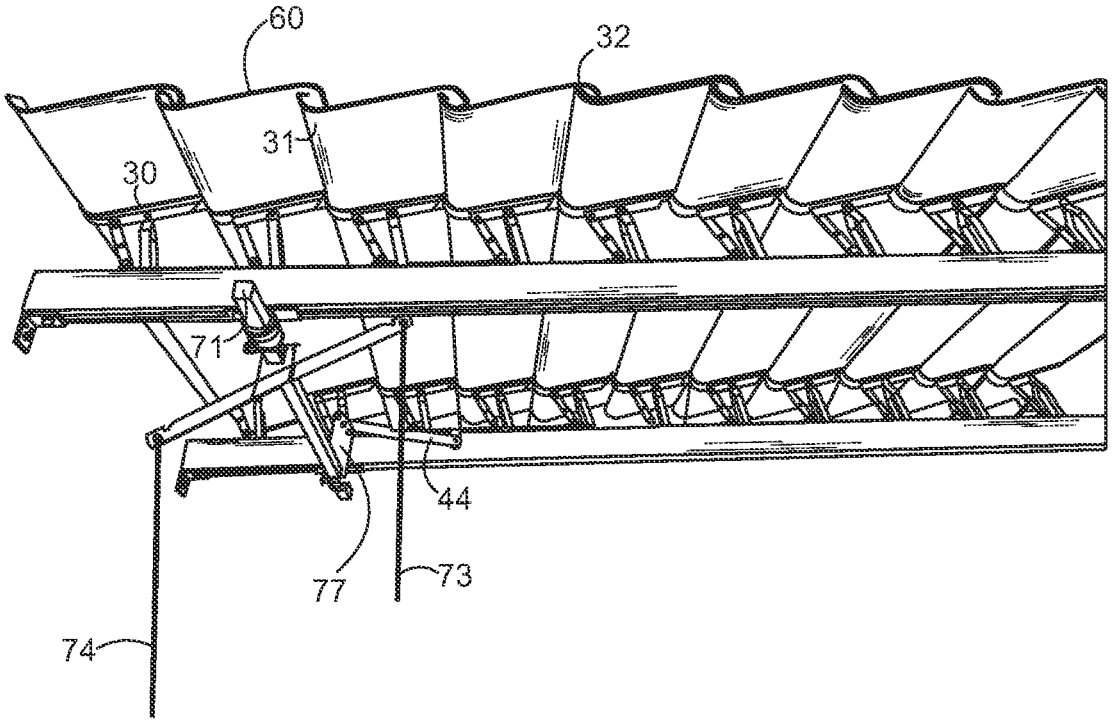
FIG. 7 is a user's view of the assembled pergola.

As seen in FIG. 7, the louvers can nest with each other to create a fully closed roof structure or wall structure.

Figure 8:
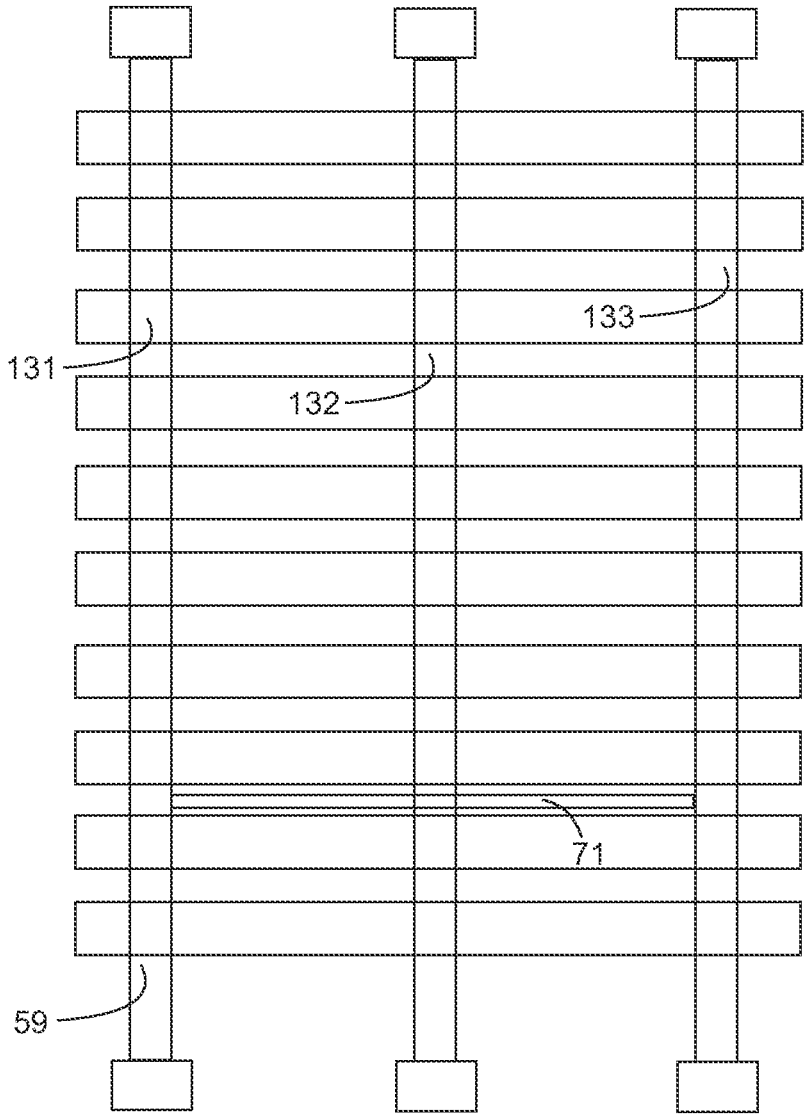
FIG. 8 is a top view diagram of the assembled pergola.

As seen in FIG. 8, a first row of louver clips 131 can be a right row of louver clips and second row of louver clips 132 can be a left row of louver clips and can be mounted on two crossbeams. A third row of louver clips 133 can be mounted parallel to the two crossbeams on a third crossbeam for example. The stem 50 is connected to an adjacent stem 150, which is in turn chained to a subsequent stem 250 in a sequential chain configuration. The links are modular and can be removed. For example, a link can be removed so that the pergola is split into more than one section. For example, in a multi-section pergola, a first pergola section can be closed and a second pergola section can be open.

A key feature of the present invention is that the play in the link is tuned properly. The first link connection connects to an adjacent stem, and the second link connection connects to a subsequent stem in a sequential chain. Each link has a small amount of play to prevent binding because each link is activated sequentially when the closing and opening action is reversed. Since each link is activated sequentially, subsequent links are not affected so then not all of the louver panels, or blades need to be started in motion simultaneously. Avoiding simultaneous motion startup minimizes binding when link tolerances are tuned to an appropriate amount.

The invention claimed is:

1. A pergola louver tilt system comprising:

a. a crossbeam having a track, wherein the track has a track groove;

b. a post, wherein the post is mounted on the crossbeam;

c. a louver clip pivotally mounted to post at a post joint;

d. a louver mounted to the louver clip;

e. a pivot link pivotally mounted to the louver clip;

f. a stem mounted to slide on the track groove, wherein the pivot link is pivotally mounted to the stem at a stem connection pivot formed on the stem; and g. a link, wherein the link is rigid and attaches to the stem and mechanically connects the stem to an adjacent stem by attaching to the adjacent stem to transmit motion from the stem to the adjacent stem, wherein the link includes a first link connection and a second link connection, wherein the first link connection connects to the stem, and wherein the second link connection connects to the adjacent stem.

2. The pergola louver tilt system of claim 1, wherein the track groove is formed on an upper surface of the crossbeam.

3. The pergola louver tilt system of claim 1, wherein the post is an inside post, and further comprising an outside post, wherein the outside post is mounted on the crossbeam adjacent to the inside post.

4. The pergola louver tilt system of claim 1, wherein the louver has a louver flat portion with a louver upper bend extending from the louver flat portion and a louver lower bend also extending from the louver flat portion, wherein the louver upper bend terminates at a louver upper hook, wherein the louver lower bend terminates at a louver lower hook.

5. The pergola louver tilt system of claim 1, wherein the stem connection pivot is formed as a stem connection opening, wherein the stem further includes a stem slot, wherein the stem slot receives the pivot link, wherein the pivot link has a flat shape configured to fit into the stem slot, wherein the pivot link rotates relative to the stem connection opening inside the stem slot.

6. The pergola louver tilt system of claim 1, wherein the link is modular and removable.

7. The pergola louver tilt system of claim 1, wherein the track groove is formed on an upper surface of the crossbeam; and wherein the post is an inside post, and further comprising an outside post, wherein the outside post is mounted on the crossbeam adjacent to the inside post.

8. The pergola louver tilt system of claim 1, wherein the post is an inside post, and further comprising an outside post, wherein the outside post is mounted on the crossbeam adjacent to the inside post, wherein the louver has a louver flat portion with a louver upper bend extending from the louver flat portion and a louver lower bend also extending from the louver flat portion, wherein the louver upper bend terminates at a louver upper hook, wherein the louver lower bend terminates at a louver lower hook.

9. The pergola louver tilt system of claim 1, wherein the louver has a louver flat portion with a louver upper bend extending from the louver flat portion and a louver lower bend also extending from the louver flat portion, wherein the louver upper bend terminates at a louver upper hook, wherein the louver lower bend terminates at a louver lower hook, wherein the stem connection pivot is formed as a stem connection opening, wherein the stem further includes a stem slot, wherein the stem slot receives the pivot link, wherein the pivot link has a flat shape configured to fit into the stem slot, wherein the pivot link rotates relative to the stem connection opening inside the stem slot.

10. The pergola louver tilt system of claim 1, wherein the stem connection pivot is formed as a stem connection opening, wherein the stem further includes a stem slot, wherein the stem slot receives the pivot link, wherein the pivot link has a flat shape configured to fit into the stem slot, wherein the pivot link rotates relative to the stem connection opening inside the stem slot, wherein the link is modular and removable.

11. The pergola louver tilt system of claim 1, wherein the track groove is formed on an upper surface of the crossbeam, wherein the link is modular and removable.

12. The pergola louver tilt system of claim 1, wherein the louver clip further includes a clip flange mount formed as a flat rib extending perpendicularly from the louver clip toward the post, wherein the clip flange mount is pivotally mounted to the post joint.

13. The pergola louver tilt system of claim 12, wherein the track groove is formed on an upper surface of the crossbeam.

14. The pergola louver tilt system of claim 12, wherein the post is an inside post, and further comprising an outside post, wherein the outside post is mounted on the crossbeam adjacent to the inside post.

15. The pergola louver tilt system of claim 12, wherein the louver has a louver flat portion with a louver upper bend extending from the louver flat portion and a louver lower bend also extending from the louver flat portion, wherein the louver upper bend terminates at a louver upper hook, wherein the louver lower bend terminates at a louver lower hook.

16. The pergola louver tilt system of claim 12, wherein the stem connection pivot is formed as a stem connection opening, wherein the stem further includes a stem slot, wherein the stem slot receives the pivot link, wherein the pivot link has a flat shape configured to fit into the stem slot, wherein the pivot link rotates relative to the stem connection opening inside the stem slot.

17. The pergola louver tilt system of claim 12, wherein the link is modular and removable.

* * * * *